US006176207B1

(12) United States Patent
Wright et al.

(10) Patent No.: US 6,176,207 B1
(45) Date of Patent: Jan. 23, 2001

(54) ELECTRONICALLY CONTROLLING THE LANDING OF AN ARMATURE IN AN ELECTROMECHANICAL ACTUATOR

(75) Inventors: Danny O. Wright, Cobb's Creek; Perry R. Czimmek, Yorktown, both of VA (US)

(73) Assignee: Siemens Corporation, Auburn Hills, MI (US)

( * ) Notice: Under 35 U.S.C. 154(b), the term of this patent shall be extended for 0 days.

(21) Appl. No.: 09/025,986

(22) Filed: Feb. 19, 1998

Related U.S. Application Data

(60) Provisional application No. 60/067,872, filed on Dec. 8, 1997.

(51) Int. Cl.[7] ..... F01L 9/04

(52) U.S. Cl. ..... 123/90.11; 251/129.01; 251/129.16; 361/160; 361/179

(58) Field of Search ..... 123/90.11; 361/160, 361/166, 167, 168.1, 179, 194; 251/129.01, 129.05, 129.06, 129.09, 129.1, 129.15, 129.16

(56) References Cited

U.S. PATENT DOCUMENTS

| | | | | |
|---|---|---|---|---|
| 4,515,343 | | 5/1985 | Pischinger et al. . | |
| 5,523,684 | * | 6/1996 | Zimmermann | 324/207.22 |
| 5,769,043 | * | 6/1998 | Nitkiewicz | 123/90.11 |
| 5,785,016 | * | 7/1998 | Enderle et al. | 123/90.11 |
| 5,797,360 | * | 8/1998 | Pischinger et al. | 123/90.11 |
| 5,868,108 | * | 2/1999 | Schmitz et al. | 123/90.11 |
| 5,887,553 | * | 3/1999 | Ballmann et al. | 123/90.11 |

* cited by examiner

*Primary Examiner*—Weilun Lo

(57) ABSTRACT

Sensing magnetic flux in an electromechanical actuator having dual axially opposed stators and dual springs, a control system modifies the rise of flux in such a manner to produce a substantially zero velocity landing of an armature against the stators. The flux is sensing by means of a sensor such as a hall effect sensor that is mounted each stator. The control system controls the flux rise when the armature is within the landing zone of the armature against the stator to match the spring rate of axially opposed springs in the actuator.

26 Claims, 3 Drawing Sheets

ELECTRONICALLY CONTROLLING THE LANDING OF AN ARMATURE IN AN ELECTROMECHANICAL ACTUATOR

This application claims the benefit of U.S. Provisional Application No. 60/067,872, filed Dec. 8, 1997.

FIELD OF INVENTION

This invention relates to high speed, high force electromechanical actuators as may be found in actuators such as are used in electronic control of the opening and closing of engine valves in an internal combustion engine. More particularly a system for controlling the landing speed of the armature against the stator.

BACKGROUND OF INVENTION

In U.S. Pat. No. 4,515,343, there is taught a contact damper at one end of the travel of the armature to provide dampening as the armature approaches the pole piece. In other systems, the power to the actuator is applied to move the armature across the gap and when the armature is close to the stator, a magnetic force from the stator coil is removed to slow down the armature and hope for a "soft", near zero velocity, landing. Just before the landing, the stator coil is then re-energized to pull the armature into a landing. The actuator has at least two opposing springs which sequentially release their potential energy to move the armature from one stator pole to the other. The stator coils, i.e. the receiving coil when energized, adds enough force to the stored up and released spring force to move and seat the armature.

The purpose of the actuator is to open and close an engine valve of an internal combustion engine.

The problem is to devise a control algorithm that provides enough extra energy from the stator coils to always complete the armature travel during a stroke but at the same time produce a "soft" (near zero velocity) landing of the armature against a stator to prevent excessive impact wear on the armature and stator and to reduce the amount of noise produced by such impact.

SUMMARY OF INVENTION

An electronic control system for controlling the movement of an armature in an electromechanical actuator, has dual coils, one at each end of the travel of an armature. The armature is mounted intermediate the ends of a shaft having an engine valve coupled through a hydraulic valve adjuster at one end and a shaft extension means axially extending from the armature at the other end. Dual spring means are coupled to the armature shaft to store up potential energy, which when released provides kinetic energy along with the magnetic energy of one of the coils to pull the armature across the gap between the pair of axially aligned coils. Each of the stators are coupled to one or more flux sensors. The flux sensors sense the rise of magnetic flux in the receiving coil and supplies this information to an electronic circuit. Timing means controls the application of power to both coils to turn off one coil to launch the armature and to briefly turn on the second or receiving coil to pull the armature and then after a time period to return on the receiving coil to catch the armature. The turning on of the receiving coil to generate "catch current" is controlled from system timing and the flux sensor for sensing the build-up of magnetic flux, hence magnetic force in the armature. Once the armature seats on the receiving stator, the catch current is changed to a hold current holding the armature until the next operation of the valve. By controlling the build up of the flux, the armature has a soft landing on the stator face.

In the preferred embodiment, a hall sensor has been positioned in or on the stators to measure the flux and flux change. The important characteristic of the sensor is that it accurately measures the flux being generated by an electrical field or the flux being generated in response to the movement of the armature. Such sensors can be mounted in or on the stators, in or on the armature, coupled to the armature or valve stem or any other location that is magnetically responsive to the movement of the armature and or its shaft.

DETAILED DESCRIPTION

Figure 1:
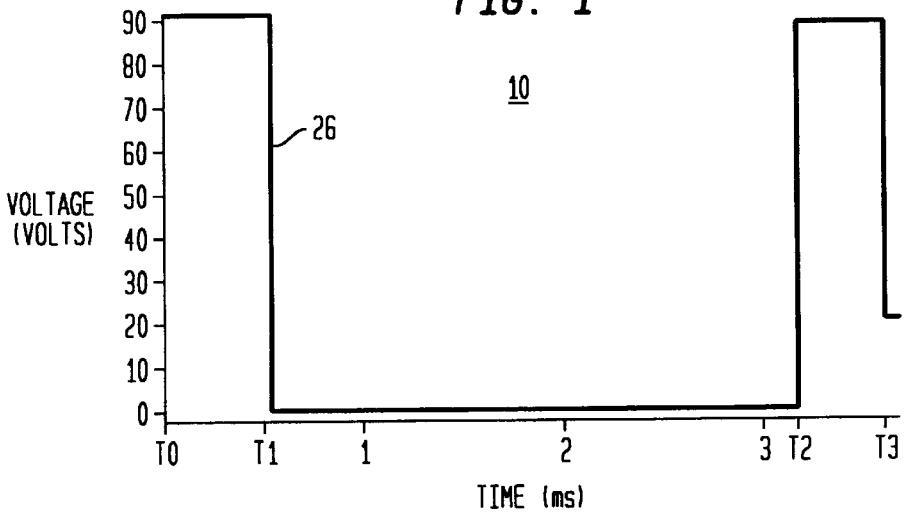
FIG. 1 is a voltage waveform as applied to the actuator in an open loop control mode.

Referring to the Figs. by the characters of reference, there is illustrated in FIG. 1 a system voltage timing wave form 10. For the purposes of explaining the operation of the system, the bottom stator 12 coil 13 of FIGS. 6 and 7 will be identified as the valve open or bottom coil and the axially opposed coil, or the upper stator 14 coil 15 will be identified as the valve closed or receiving coil or upper coil. When the bottom coil 13 is energized, the armature 16 is seated against the stator bottom 12 holding the valve 18 open. Conversely, when the upper coil 15 is energized, the armature 16 is seated against the upper stator 14 holding the valve 18 closed. As will be seen, there are also times when one of the coils 13, 15 is energized and the armature 16 is moving across the gap between stators 12, 14.

An example of such an armature and actuator is found in copending patent applications "Armature for Electromagnetic valve Actuator" filed Dec. 9, 1997 having Ser. No. 60/067,984 and "Electromagnetic Valve Actuator" filed Dec. 9, 1997 having Ser. No. 60/069,144 both of which are incorporated herein by reference.

Figure 6:
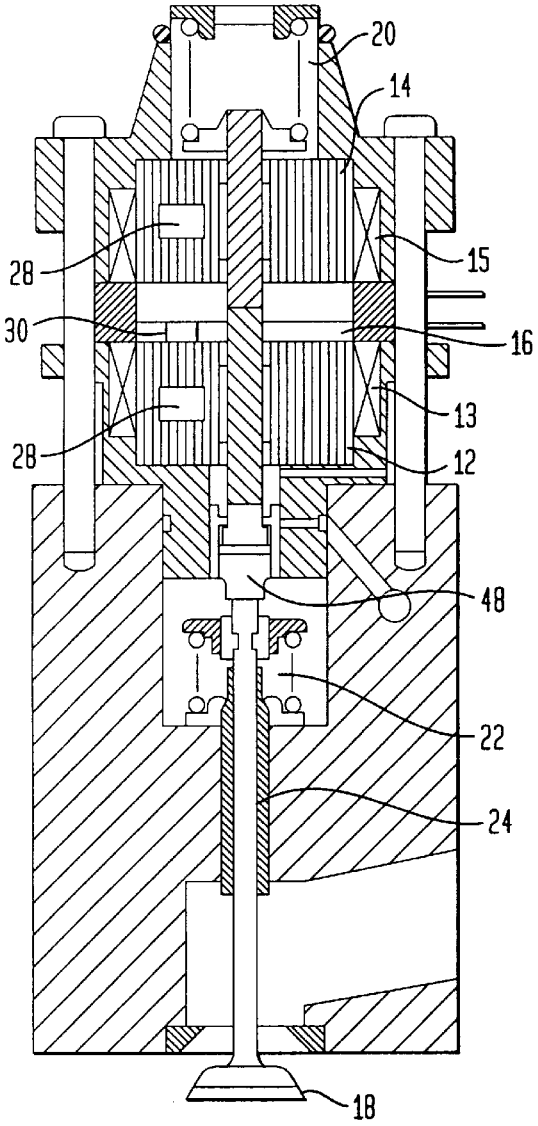
FIG. 6 is a sectional view of an actuator in the open position just prior to the application of the voltage of FIG. 1.
Figure 7:
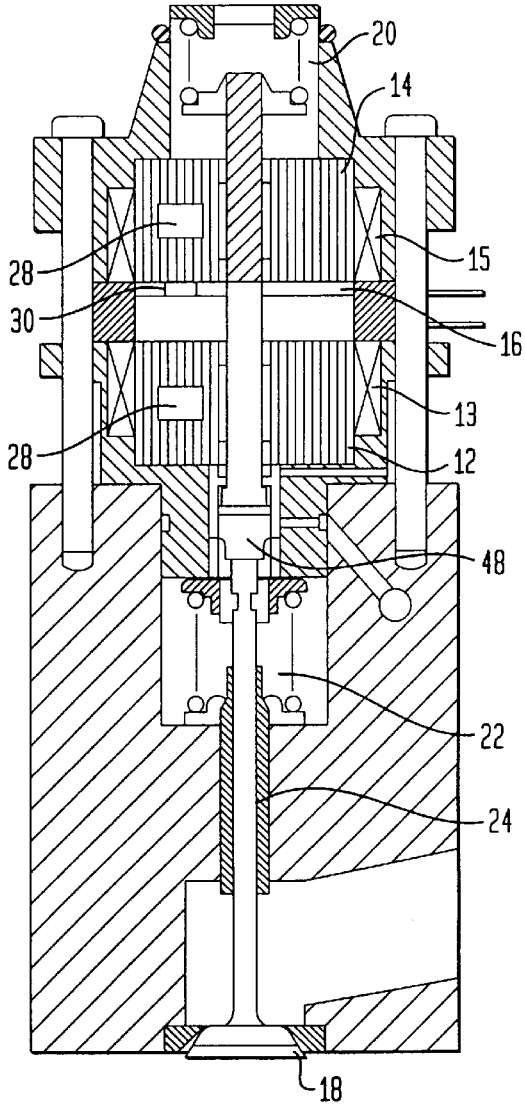
FIG. 7 is a sectional view of an actuator in the closed position after the armature has traveled across the gap.

In normal operation to go to valve 18 closed as shown in FIG. 7 from valve open as shown in FIG. 6, full voltage is applied to the upper coil 15 at the beginning of an armature stroke at time T, to get the armature 16 moving. Simultaneously power is removed from the bottom coil 13 to release the armature 16 from the bottom stator 12. Once the armature 16 is moving, the voltage at the upper coil 15 is removed at time T1 to permit the armature 16 to travel as a spring-mass system under simple harmonic motion until it is near closing. The oppositely opposed bias springs 20, 22 function to store potential energy when compressed and deliver kinetic energy when the armature 16 is released. Then at time T2, full coil voltage is applied to the upper or receiving coil 15 to initiate the catch current phase. Finally at time T3, the coil voltage on the receiving coil 15 is reduced to a value sufficient to provide the hold current for holding the armature 16 against the upper stator 14 and against an opposing compressed spring 20. This is a bang-bang type of optimal control.

The of the spring means 22, as illustrated in FIGS. 6 and 7, functions as the normal valve spring that, absent the electromagnetic actuators, would normally hold the valve 18 closed. The second spring means 20 is another spring which is positioned at the end of the shaft means 24 axially extending from the armature 16 which is positioned to open the valve 18. The springs 20, 22 are balanced and in their normal position, neither of the stator coils 13, 15 being energized, the armature 16 would be balanced between the stators and the valve 18 is partially opened.

Figure 2:
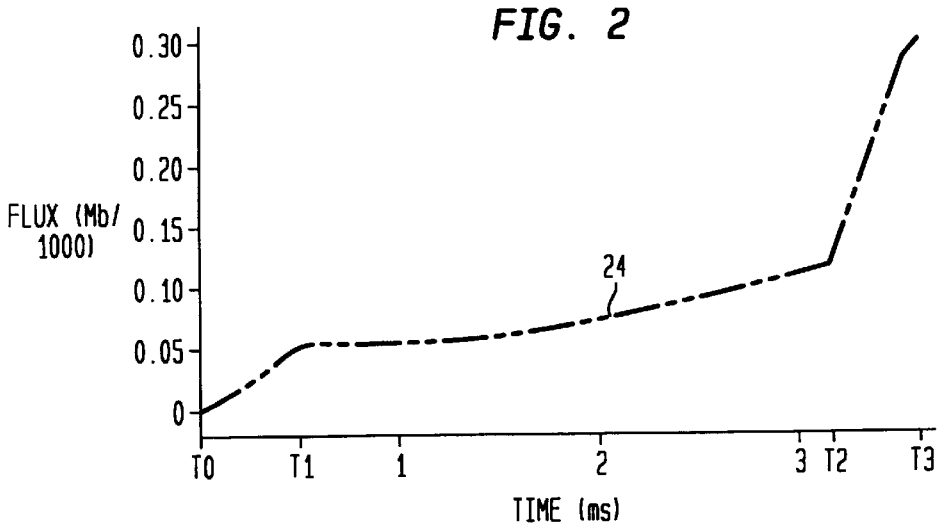
FIG. 2 is a waveform of flux generation in an actuator of FIG. 6 in the system operation as described for FIG. 1.

FIG. 2 is a simplified flux wave form 24 for the system of FIG. 1 without the present invention. When the initial voltage pulse 26 is applied to the coils 13 or 15, the flux begins to build up until T1. At time T1, the voltage is removed and as the armature 16 is moving across the gap, there is only a slight amount of flux increase. At time T2 the voltage is reapplied to the coil, the flux increases rapidly and at T3 the voltage is then reduced to provide holding current. In theory, values can be calculated for time T1, T2 and T3 to achieve the desirable soft landing of the armature 16 against the stator 14. In practice, however, this is almost never achievable because the system is constantly being perturbed by real world variable parameters such as damping, temperature, deflections, tolerance stack up, vibration, engine gas loads, etc., to name a few.

Laboratory tests with very careful adjustment of the catch current, i.e. the current resulting from the voltage applied at T2, in conjunction with viscous oil damping has yielded single stroke soft landings. However, a more typical performance is where the landing is quite harsh at a velocity of approximately 1.0 meters per second. A velocity value of 0.7 meters per second appears to be the practical limit achievable in open loop actuator control mode to insure completion of every armature stroke. The required velocity value of the armature 16 calculated to provide "quiet" actuator operation is less than 0.04 meters per second at 600 engine rpm and less than 0.4 meters per second at 6000 engine rpm.

From this it is clearly understood that some form of feedback algorithm is required to increase the robustness of the armature control. Conventional approaches to the feedback problem have proved effective in simulation, but as hereinbefore noted, have failed in the real world. The common point of failure for these techniques has been the inability to process the required feedback equations in the allotted time and to sense the required stated variables with sufficient accuracy and resolution. For example, analysis testing has shown that a position sensor must resolve the eight millimeter armature stroke distance to an error of less than ten microns (0.125%) in the presence of high engine vibration and electrical noise. At the present this is not feasible in a serial production design. Consider that a typical engine has four valves per cylinder, such an electronic valve timing system would then require four actuators, similar to that illustrated in FIG. 6, for each cylinder. Multiply this by the number of cylinders times the number of engines and the magnitude of the problem is seen.

Figure 3:
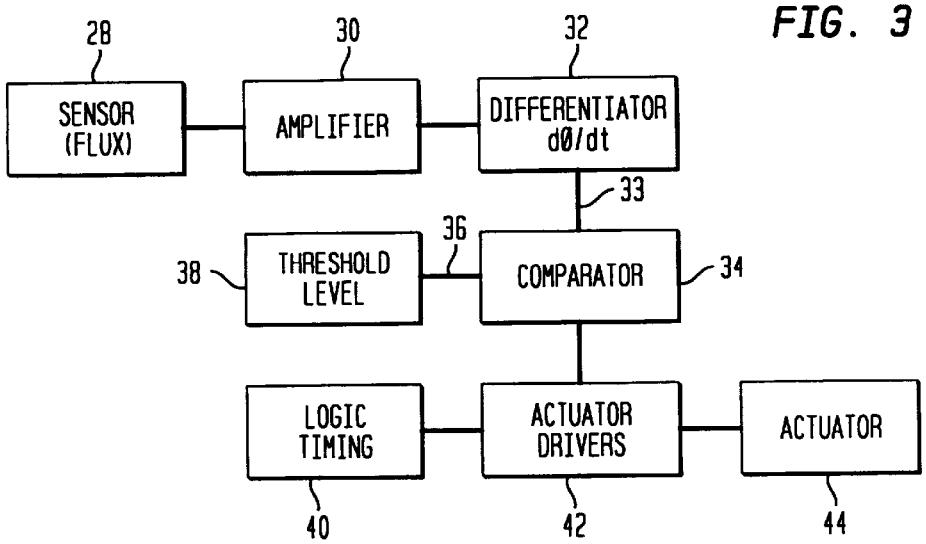
FIG. 3 is a block diagram of an operating system according to the present invention to achieve zero velocity landing of the armature.

FIG. 3 is a block diagram of an operating system according to the present invention to achieve zero velocity landing of the armature 16. Again for the purposes of description, the armature 16 is moving from the bottom coil 13 and stator 12 to the upper coil 15 and stator 14 or the valve 18 is going from open to close. This system is based on controlling the armature velocity near landing by regulating the rate of change of magnetic flux in the armature/stator core magnetic circuit. The flux is sensed by means of a sensor 28. There are many types of sensors such as a Hall sensor, GMR sensor, eddy current sensors, and even employing the non-energized stator coil of the actuator to sense the time derivative of the flux. In the preferred embodiment a Hall sensor 28 was used.

Refer to FIGS. 6 and 7 there is illustrated one location of the Hall sensor 28 and that is in each stator core 12, 14. Another location of the sensor may well be on the armature 16 itself. The selection of using a flux sensor has the following advantages;

(1) a flux sensor is extremely sensitive in response (inverse square law) to the armature motion in the region near the landing and (2) its signal voltage is monotonically increasing with increasing displacement of the armature (i.e. as the armature approaches its landing).

Figure 4:
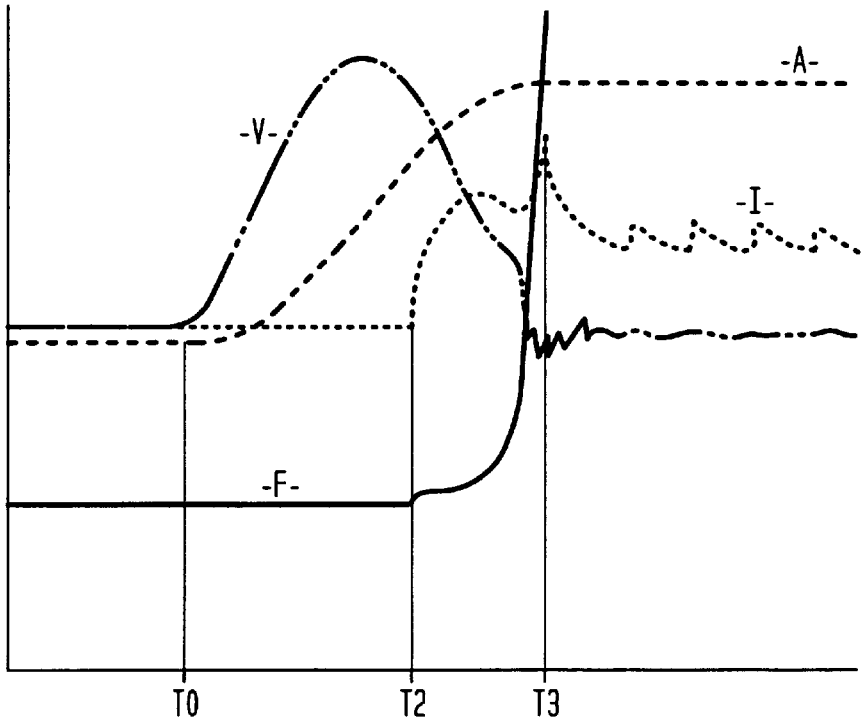
FIG. 4 (PRIOR ART)
FIG. 4 is a graphic representation of a prior art actuation of an actuator in a nominal open loop control.
Figure 5:
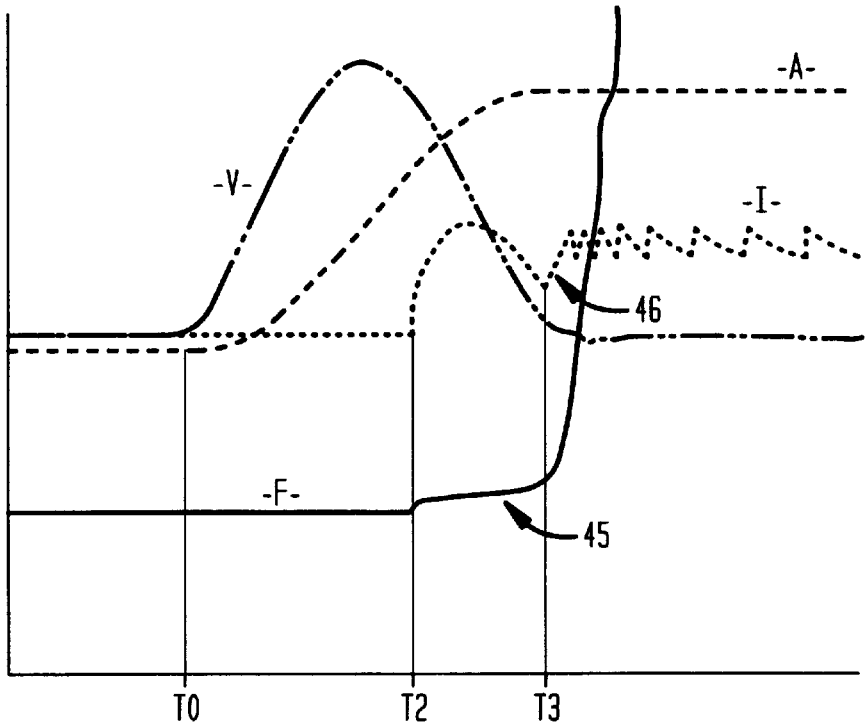
FIG. 5 is a graphic representation of the actuation of an actuator according to the present invention.

The theoretical wave form 24 is illustrated in FIG. 2 and in FIGS. 4 and 5, the wave shape labeled "F" is copied from a trace on an oscilloscope. FIG. 4 is very similar to FIG. 2 and FIG. 5 illustrates the desired wave shapes as a result of the invention.

The system of FIG. 3 has a flux sensor 28, an amplifier 30 and a differentiator 32 feeding one leg 33 of a comparator 34. The other leg 36 of the comparator 34 is a threshold level device 38. The output of the comparator 34 is "logically anded" with a logic timing component 40 and is supplied to the drive circuit 42 of the actuators 44. Once the actuator drivers are energized, the actuator coil is energized.

The flux sensor 28 has its output waveform amplified and differentiated. The flux sensor wave shape is illustrated in FIG. 5 as waveform "F". The threshold level is used to control the flux between T2 and T3 as illustrated in FIG. 5. This is a closed loop control and the velocity waveform, labeled "V", illustrates a landing velocity near zero at or near T3. The key feature in FIG. 5 is that the highly nonlinear characteristic of the flux buildup, which also represents the force on the armature 16, is forced to build linearly in the region near the impact. The buildup of the flux in this region 45, between T2 and T3, is set by the catch current becomes an "inclined line" electronically equivalent to the spring rate of the spring 20. Thus, as the armature 16 is coming into a landing, the flux is low reducing the magnetic force from the receiving stator 14 and coil 15 causing the velocity of the armature 16 to approach zero. At T3, the flux is no long inhibited and the armature 16 is held against the stator 14.

Referring to FIGS. 4 and 5 the wave shape labeled "A" illustrates the movement of the armature 16 from one position, the sending position, to the other position, the receiving position, across the gap. The wave shape labeled "I" is the current build up in the coil 15 wound on the stator 14 that the armature 16 is approaching which in our example is the upper coil 15. This shows the change in current from T2 when the current is applied to T3 when the hold current is applied. The characteristic dip 46 in current when the armature 16 seats is illustrated.

The final value of flux, which is the force on the armature, is now set, at T3 by the hold current to just exceed the opposing spring force, the upper spring 20. This will allow a rapid release of the armature 16 at the beginning of the next stroke, to open the valve 18. In addition the hold current is defined by the minimum power required to control the actuator.

Referring to FIG. 3, the logic timing 40 is the system control timing wave forms 10 that are indicated in FIG. 1. It is a system parameter that defines the time that the armature 16 moves across the gap is between T1 and T2. At T2, the armature 16 is approaching the desired landing zone for a zero-velocity landing. At T3 the flux is allowed to build up normally.

FIGS. 6 and 7 illustrate the actuator having the normal valve spring 22 operating on the valve stem 24, the opposing valve spring 20 at the end of the valve stem 24 mechanism opposite the valve, the upper and bottom stator 12, 14 and stator coils 13, 15, and the armature 16 which is connected to the valve stem 24 through a hydraulic valve adjuster 48.

It is to be understood, while the description heretofore has been limited to just one of the coils, it also applies to the other coil and the travel of the armature in the opposite direction. A key feature is that this invention removes the highly non-linear characteristic of the flux buildup, and hence the force on the armature, and forces the flux to build linearly in the region near impact which is illustrated in FIG. 5. The final value of flux is set by the hold current to just exceed the opposing spring force. The result allows a rapid release of the armature at the beginning of the next stroke and the minimum power required to control the actuator.

There has thus been described and defined an electronic control system for the movement of an armature from a sending position to a receiving position and controlling the landing speed of the armature against the stator to a near zero velocity thereby minimizing the impact force.

What is claimed is:

1. An electronic control system for controlling the movement of an armature in an electromechanical actuator, the system comprising:

a timing generator generating a plurality of pulsed electrical signals, said signals and the time between said signals representing the operational timing of the actuator;

an armature having a first position and movable to a second position in response to said pulsed electrical signals;

a spring bias means for biasing said armature in said first position, said spring bias means having a defined spring rate;

a stator in said second position, said stator having a winding with a first and second terminal;

an electrical circuit means electrically connected to said winding and operable in response to said timing generator to supply a voltage to said winding for generating magnetic flux in said stator, said magnetic flux operable to attract said armature;

a magnetic flux sensor operatively attached to said stator and responsive to said magnetic flux generated therein; and control means operatively connected to said flux sensor, said control means responsive to said timing generator for responding to a rate of change of said magnetic flux to modify the rise of magnetic flux in said stator for matching the spring rate of said spring bias means to control the impact velocity of said armature against said stator.

2. The electronic control system according to claim 1 wherein said armature is operatively connected to an engine valve in an internal combustion engine.

3. The electronic control system according to claim 1 wherein said flux sensor is a hall effect sensor.

4. The electronic control system according to claim 1 wherein said stator comprises a plurality of laminations and said flux sensor is mounted in said laminations and responsive to the flux generated in said stator.

5. The electronic control system according to claim 1 wherein said flux sensor is mounted on said armature and is responsive to the flux generated in said armature.

6. A method for controlling the movement of an armature in an electromechanical actuator, the method comprising the steps of:

generating a plurality of pulsed electrical signals, said signals and the time between said signals representing the operational timing of the actuator;

biasing said armature having a first position and movable to a second position against a stator having a winding in response to the pulsed electrical signals, the bias represented by a defined spring rate;

electrically connecting the winding to an electrical circuit for operating in response to the pulsed electrical signals to supply a voltage to the winding for generating magnetic flux in said stator, said magnetic flux operable to attract the armature;

sensing magnetic flux generated in the stator; and then modifying in response to a rate of change of the sensed magnetic flux and said pulsed electrical signals the rise of magnetic flux in the stator for matching the spring rate of the bias for controlling the impact velocity of the armature against the stator.

7. The method according to claim 6 wherein the armature is operatively connected to an engine valve in an internal combustion engine.

8. The electronic control system according to claim 6 wherein the step of sensing said flux sensor is by means of a hall effect sensor.

9. The electronic control system according to claim 6 wherein the stator comprises a plurality of laminations and said step of sensing is by means of a flux sensor mounted in the laminations and responsive to the flux generated in the stator.

10. The electronic control system according to claim 6 wherein the step of sensing the magnetic flux is by a sensor mounted on the armature and responsive to the flux generated in the armature.

11. An electronic control system for controlling the movement of an armature in an electromechanical actuator, the system comprising:

a timing generator generating a plurality of pulsed electrical signals, said signals and the time between said signals representing the operational timing of the control system;

dual stators axially positioned in a spaced apart relationship along a common axis, each of said dual stators having substantially identical windings;

an armature member having a flat member positioned between said dual stators and having a pair of opposed axially extending members from the center of rotation of said flat member through each of said stators, said armature having a first position against one of said stators and reciprocally movable to a second position against the other of said stators in response to said pulsed electrical signals;

dual spring bias members one on each side of said flat member and axially aligned on said opposed axially extending members for biasing said armature in said first and second positions, said spring bias members having equally defined spring rates, wherein said armature in the absence of any external forces is normally biased equidistant from each of said dual stators;

an electrical circuit means electrically connected to said windings and operable in response to said timing generator to supply a voltage to one of said windings for generating magnetic flux in said stator coupled to said winding, said magnetic flux operable to attract said armature to one of said stators for compressing one of said spring members storing potential energy and for extending the other of said spring members for releasing kinetic energy;

a magnetic flux sensor operatively attached to each one of said dual stators and responsive to said magnetic flux generated therein, control means operatively connected to said flux sensors, said control means responsive to said timing generator for responding to a rate of change of said magnetic flux to modify the rise of magnetic flux in said stators for matching the spring rate of said spring bias members storing potential energy to control the landing speed of said armature flat member against said stators.

12. The electronic control system according to claim 11 wherein said armature is operatively connected along said common axis to an engine valve in an internal combustion engine.

13. The electronic control system according to claim 11 wherein said dual flux sensors are hall effect sensors.

14. The electronic control system according to claim 11 wherein said dual stators comprises a plurality of laminations and one of said flux sensors is mounted on the surface of said laminations of each stator and responsive to the flux generated in said respective stator.

15. The electronic control system according to claim 11 wherein said flux sensor is mounted on said armature and is responsive to the flux generated in said armature.

16. A method for controlling the movement of an armature in an electromechanical actuator between a sending position and a receiving position, the method comprising the steps of:

generating a plurality of pulsed electrical signals, the signals and the time between the signals representing the operational timing of the actuator; positioning dual stators in an axially spaced apart relationship along a common axis, one of the stators being at the sending position and the other being at the receiving position, each of the dual stators having substantially identical windings;

positioning an armature member having a flat member between the dual stators, the armature member having a pair of opposed axially extending members from the center of rotation of the flat member through each of the stators;

reciprocally moving the armature between the sending position against one of the stators and the receiving position against the other of the stators in response to the pulsed electrical signals;

axially aligning on the opposed and extending members dual spring bias members one on each side of the flat member;

matching the spring rate of the spring bias members wherein the armature in the absence of any external forces is normally biased equidistant from each of the dual stators;

electrically connecting the windings to an electrical circuit for operating in response to the pulsed electrical signals for supplying a voltage to one of the windings for generating magnetic flux in the receiving stator coupled to the winding;

compressing in response to the magnetic flux, the spring members in the receiving station for storing potential energy and extending the other of the spring members in the sending station for releasing kinetic energy;

sensing the magnetic flux in each one of the dual stators; and then modifying in response to a rate of change of the sensed magnetic flux and the pulsed electrical signals the rise of magnetic flux in the receiving stator to match the spring rate of the receiving station spring bias member storing potential energy to control the landing speed of the armature flat member against the receiving station stator.

17. A method of controlling velocity of an armature of an electromagnetic actuator as the armature moves from a first position towards a second position, the electromagnetic actuator including a stator having a coil and a core at said second position, said coil generating a magnetic force to cause the armature to move towards and land at said core, and a spring structure acting on the armature to bias the armature away from said second position to a resetting position, the method including:

selectively energizing said coil to permit said armature to move at a certain velocity towards said core;

determining a rate of change of magnetic flux in a magnetic circuit created by said armature and stator when said armature is moving toward said core; and using said rate of change of magnetic flux as a feedback variable to control energy to said coil so as to control a velocity of said armature as said armature moves towards said core.

18. The method according to claim 17, wherein selectively energizing said coil includes applying a catch current to said coil when said armature is approaching said core, said catch current being controlled based on a value of rate of change of magnetic flux.

19. The method according to claim 17, wherein determining said rate of change of magnetic flux includes providing a flux sensor to sense changes in magnetic flux.

20. The method according to claim 19, wherein said flux sensor is a Hall effect sensor.

21. The method according to claim 17, wherein the velocity of said armature is controlled so as to be substantially zero as said armature lands at said core.

22. The method according to claim 18, wherein once said armature lands at said core, said catch current is changed to a current sufficient to hold said armature at said core.

23. An electromagnetic actuator comprising:

an armature movable between first and second positions;

a spring structure biasing said armature towards a resetting position generally between said first and second positions;

a stator having a coil and a core at said first position, said coil, when energized, being constructed and arranged to apply a magnetic force to the armature to cause the armature to move towards and land at said core and to maintain said armature at said core for a predetermined period; and control structure to control movement of said armature, said control structure being constructed and arranged to determine a rate of change of magnetic flux created by a magnetic circuit defined by said armature and said stator when said armature is approaching said core, and to use said rate of change of magnetic flux as a feedback variable to control energy to said coil and thus control a velocity of said armature as said armature moves towards said core.

24. The electromagnetic actuator according to claim 23, wherein said control structure includes a flux sensor to determine said rate of change of magnetic flux.

25. The electromagnetic actuator according to claim 24, wherein said flux sensor is a Hall effect sensor.

26. The electromagnetic actuator according to claim 23, wherein said control structure is constructed and arranged to control a velocity of said armature to be substantially zero upon landing of said armature at said core.

* * * * *